US006150800A

United States Patent [19]

Kinoshita et al.

[11] Patent Number: 6,150,800

[45] Date of Patent: Nov. 21, 2000

[54] POWER CIRCUIT INCLUDING INRUSH CURRENT LIMITER, AND INTEGRATED CIRCUIT INCLUDING THE POWER CIRCUIT

[75] Inventors: Masayoshi Kinoshita; Shiro Sakiyama, both of Osaka; Jun Kajiwara, Kyoto; Katsuji Satomi; Hiroo Yamamoto, both of Osaka; Katsuhiro Ootani, Nara, all of Japan

[73] Assignee: Matsushita Electric Industrial Co., Ltd., Osaka, Japan

[21] Appl. No.: 09/395,971

[22] Filed: Sep. 15, 1999

[30] Foreign Application Priority Data

Sep. 16, 1998 [JP] Japan ..... 10-261042

[51] Int. Cl.[7] ..... G05F 1/40

[52] U.S. Cl. ..... 323/280; 323/274; 323/908

[58] Field of Search ..... 323/280, 274, 323/279, 281, 908, 316, 317, 901

[56] References Cited

U.S. PATENT DOCUMENTS

| | | | |
|---|---|---|---|
| 4,355,341 | 10/1982 | Kaplan | 361/86 |
| 4,779,060 | 10/1988 | Henden | 330/227 |
| 5,446,380 | 8/1995 | Theus et al. . | |
| 5,453,678 | 9/1995 | Bertolini et al. | 323/282 |
| 5,619,127 | 4/1997 | Warizaya . | |
| 5,666,044 | 9/1997 | Tuozzolo . | |
| 6,025,704 | 2/2000 | Elliott | 323/280 |

FOREIGN PATENT DOCUMENTS

| | | |
|---|---|---|
| 0735452 | 2/1996 | European Pat. Off. . |
| 0810504 | 12/1997 | European Pat. Off. . |
| 3405847 | 8/1985 | Germany . |
| 4242989 | 5/1994 | Germany . |
| 8-154338 | 6/1996 | Japan . |

*Primary Examiner*—Shawn Riley
*Attorney, Agent, or Firm*—Eric J. Robinson; Nixon Peabody LLP

[57] ABSTRACT

A power circuit including means for preventing the generation of an inrush current during the power circuit's initial operation without increasing the size of the power circuit is described. The power circuit comprises an output transistor for supplying a current from a power supply to an output terminal, and a differential amplifier for controlling the current supplied by the output transistor in such a manner as to regulate a voltage at the output terminal based on a preset reference voltage. A limiting transistor is provided as a source follower on a current path at the output stage of the differential amplifier. The gate potential of the output transistor is controlled using the source potential of the limiting transistor. Before the power circuit starts to operate, an operation controller charges a capacitor to control the gate potential of the limiting transistor so that during the initial operation of the power circuit, the capacitor is discharged by using a current source. Accordingly, during the initial operation of the power circuit, the gate potential of the limiting transistor gradually decreases while the gate-source voltage of the output transistor gradually increases. As a result, the generation of the inrush current can be suppressed.

13 Claims, 15 Drawing Sheets

POWER CIRCUIT INCLUDING INRUSH CURRENT LIMITER, AND INTEGRATED CIRCUIT INCLUDING THE POWER CIRCUIT

BACKGROUND OF THE INVENTION

The present invention generally relates to a power circuit for converting a supply voltage and outputting the voltage converted, and more particularly relates to a technique of limiting an inrush current during the initial operation of the power circuit.

An integrated circuit may include several components operating at a voltage different from a given supply voltage. In such a situation, a power circuit is used to convert the supply voltage into a required voltage and output the voltage converted.

FIG. 17 illustrates a configuration of a conventional power circuit. The power circuit shown in FIG. 17 includes an output transistor 1, a differential amplifier 2 and a smoothing capacitor 3. The output transistor 1 supplies a current to a load connected to an output terminal 4. The differential amplifier 2 controls the current supplied by the output transistor 1 at such a value as equalizing an output voltage OUT output through the output terminal 4 with a reference voltage REF applied to a reference terminal 5. And the smoothing capacitor 3 is provided to remove abrupt fluctuations in the output current of the load.

In the conventional power circuit shown in FIG. 17, however, the output transistor 1 can supply a maximum possible current during the initial operation of the circuit. Thus, an excessively large current, i.e., a so-called "inrush current", might flow from a power supply 100 into the smoothing capacitor 3 via the output transistor 1. Such an inrush current might adversely affect, or damage, the devices of an LSI including the power circuit or external components.

According to an exemplary technique of suppressing the generation of inrush current, an inrush-current-limiting bipolar transistor is connected in series to an output transistor (see Japanese Laid-Open Publication No. 8-154338, for example). In general, the ratio of the emitter-collector current of a bipolar transistor to the base current thereof is equal to or smaller than the current amplification ratio of the base current. Thus, the proposed circuit allegedly suppresses the generation of the inrush current by limiting the base current of the inrush-current-limiting bipolar transistor.

In such a case, however, a process for fabricating the bipolar transistor is required. Accordingly, if the output transistor and the differential amplifier are implemented as MOS transistors, for example, then the fabrication process of such a circuit gets overly complicated.

Also, the inrush-current-limiting transistor is connected in series to the output transistor 1. Accordingly, the channel of the inrush-current-limiting transistor should be wide enough to supply a large current as the output current, thus increasing the layout area and the overall cost of the power circuit. In addition, when a large current is output, a voltage drop between the emitter and collector of the inrush-current-limiting transistor is large. Thus, it is impossible to supply an output voltage approximating the supply voltage. To suppress the voltage drop caused by the inrush-current-limiting transistor, the channel width thereof should be increased. However, the layout area of the power circuit further increases in such a case.

SUMMARY OF THE INVENTION

An object of the present invention is providing a power circuit that can limit the inrush current during the initial operation thereof by adopting a different configuration than the conventional one.

Another object of the present invention is implementing an inrush-current-limiting power circuit substantially without increasing its layout area.

Still another object of the present invention is fabricating the power circuit only by a CMOS process.

Specifically, a power circuit according to the present invention is adapted to convert a supply voltage and output the voltage converted. The power circuit includes: an output transistor for supplying a current from a power supply to an output terminal; a differential amplifier for controlling the current supplied by the output transistor in such a manner as to regulate a voltage at the output terminal based on a preset reference voltage; and means for limiting an inrush current by gradually increasing the current supplied by the output transistor during an initial operation of the power circuit.

According to the present invention, the current supplied by the output transistor is gradually increased by the inrush-current-limiting means during the initial operation of the power circuit. Thus, it is possible to suppress the generation of the inrush current during the initial operation using a different configuration than the conventional one.

In one embodiment of the present invention, the inrush-current-limiting means preferably includes: a limiting transistor, which has such a source potential as controlling a gate potential of the output transistor and is provided on a current path at an output stage of the differential amplifier; and an operation controller for controlling a gate potential of the limiting transistor.

In such an embodiment, the gate potential of the output transistor is controlled based on the source potential of the limiting transistor, and the gate potential of the limiting transistor is controlled by the operation controller. Thus, during the initial operation of the power circuit, the limiting transistor may be operated as a source follower and the gate potential of the limiting transistor may be controlled by the operation controller at such a value as preventing the output transistor from supplying an excessively large current. In this manner, the generation of the inrush current can be suppressed during the initial operation.

In addition, since the limiting transistor is implementable as an MOS transistor, for example, no bipolar process is needed and an inrush-current-limiting power circuit can be fabricating only by a CMOS process.

Moreover, since the limiting transistor is not connected in series to the output transistor, but is provided on the current path at the output stage of the differential amplifier, the output current does not flow through the limiting transistor. Accordingly, the limiting transistor need not have its channel width increased, and therefore, the generation of the inrush current can be suppressed substantially without increasing the layout area of the power circuit. Furthermore, the output voltage does not decrease due to the voltage drop at the limiting transistor. Thus, even when a large current should be supplied as the output current, an output voltage approximating the supply voltage can be supplied.

In another embodiment of the present invention, the operation controller preferably controls the gate potential of the limiting transistor at such a value as preventing the output transistor from supplying an excessively large current during the initial operation of the power circuit. On the other hand, during a normal operation of the circuit, the operation controller preferably controls the gate potential of the limiting transistor at such a value as turning the limiting transistor ON.

In still another embodiment, the operation controller preferably includes: a capacitor, a potential at one terminal of which is used to control the gate potential of the limiting transistor; capacitor initializing means for setting a voltage of the capacitor at a predetermined voltage before the power circuit starts to operate; and a current source, which is selectively turned ON to gradually charge or discharge the capacitor.

In this particular embodiment, the capacitor initializing means preferably includes a switch, which is selectively turned ON, and a transistor, which is connected to form a diode. The switch and the diode-connected transistor are both connected in series between the terminal of the capacitor and a power supply terminal or a ground terminal.

In an alternate embodiment, the operation controller may include a plurality of the current sources, which are selectively turned ON.

In another alternate embodiment, the operation controller may include a plurality of the capacitors, which are selectively charged or discharged.

In still another embodiment, the operation controller may be supplied with first and second control potentials, which are selected by the operation controller during the initial operation and the normal operation of the power circuit, respectively. And the operation controller may control the gate potential of the limiting transistor in accordance with the control voltage selected.

In still another embodiment, the operation controller may include: a bank of resistors that are connected in series to each other, the bank dividing a potential between both terminals thereof into a plurality of potentials; and means for selecting one of the potentials produced by the bank. The operation controller may control the gate potential of the limiting transistor in accordance with the potential selected by the selecting means.

In still another embodiment, the inrush-current-limiting means preferably includes: a limiting transistor, which is provided between the power supply and the output terminal and connected in series to the output transistor; and an operation controller for controlling a gate potential of the limiting transistor.

In this particular embodiment, the operation controller preferably controls the gate potential of the limiting transistor at such a value as preventing the output transistor from supplying an excessively large current during the initial operation of the power circuit. On the other hand, during a normal operation of the circuit, the operation controller preferably controls the gate potential of the limiting transistor at such a value as turning the limiting transistor ON.

In still another embodiment, the operation controller may include: a capacitor, a potential at one terminal of which is used to control the gate potential of the limiting transistor; capacitor initializing means for setting a voltage of the capacitor at a predetermined voltage before the power circuit starts to operate; and a current source, which is selectively turned ON to gradually charge or discharge the capacitor.

In still another embodiment, the inrush-current-limiting means preferably gradually increases a gate-source voltage of the output transistor from a very small value during the initial operation of the power circuit.

An integrated circuit according to the present invention includes the power circuit of the present invention and operates at a voltage that has been converted and output by the power circuit.

DESCRIPTION OF THE PREFERRED EMBODIMENTS

Hereinafter, preferred embodiments of the present invention will be described with reference to the accompanying drawings.

Embodiment 1

Figure 1:
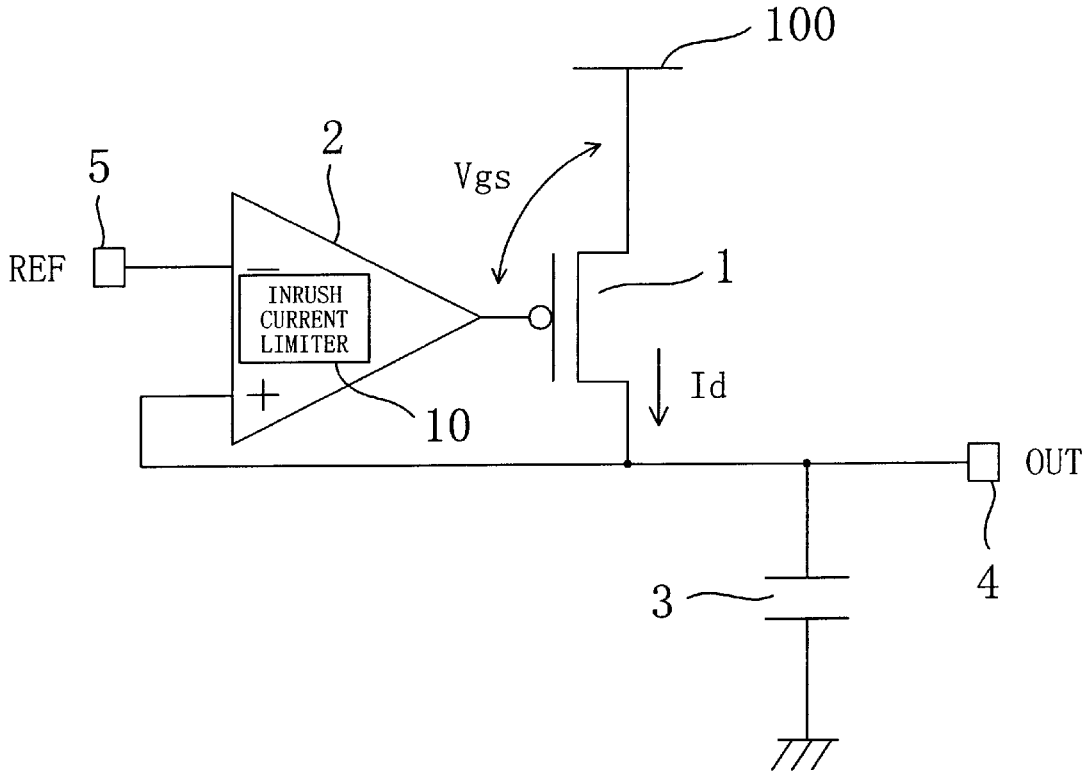
FIG. 1 is a diagram schematically illustrating a configuration of a power circuit with an inrush current limiter according to a first embodiment of the present invention.

FIG. 1 schematically illustrates a configuration of a power circuit with an inrush current limiter according to a first embodiment of the present invention. The power circuit shown in FIG. 1 also includes the output transistor 1, differential amplifier 2 and smoothing capacitor 3. The output transistor 1 supplies a current from the power supply terminal 100 to the output terminal 4. The differential amplifier 2 controls the current supplied by the output transistor 1 at such a value as equalizing the output voltage OUT at the output terminal 4 with the reference voltage REF applied at the reference terminal 5. The differential amplifier 2 includes an inrush current limiter 10 for gradually increasing the current supplied by the output transistor 1 during the initial operation of the power circuit.

Specifically, the differential amplifier 2 controls the output transistor 1 in a compulsory manner to have the gate-source voltage Vgs of the transistor 1 gradually increased from a very small value by the inrush current limiter 10 during the initial operation of the power circuit. On and after the circuit has started to operate normally, the differential amplifier 2 performs its originally intended function of controlling the output transistor 1 in such a manner to equalize the output voltage OUT thereof with the reference voltage REF.

Figure 2A:
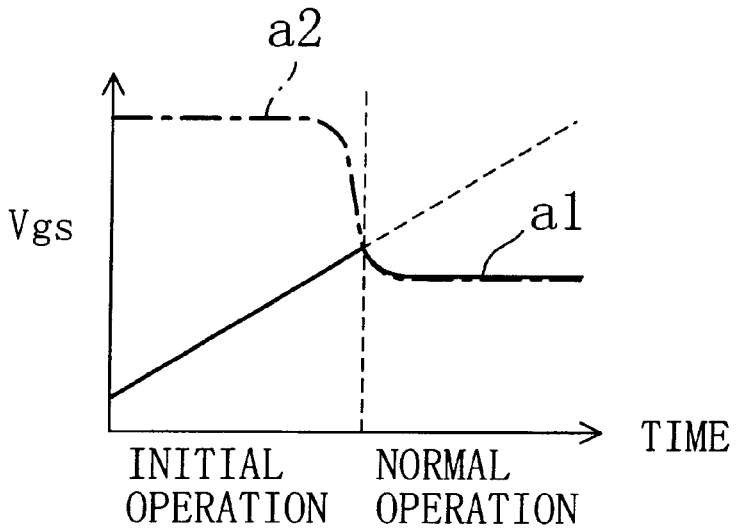
FIGS. 2(*a*) and 2(*b*) are graphs illustrating the operational concept of the power circuit shown in FIG. 1 by way of variations in gate-source voltage Vgs with time and variations in current Id supplied by the output transistor with time, respectively.
Figure 2B:
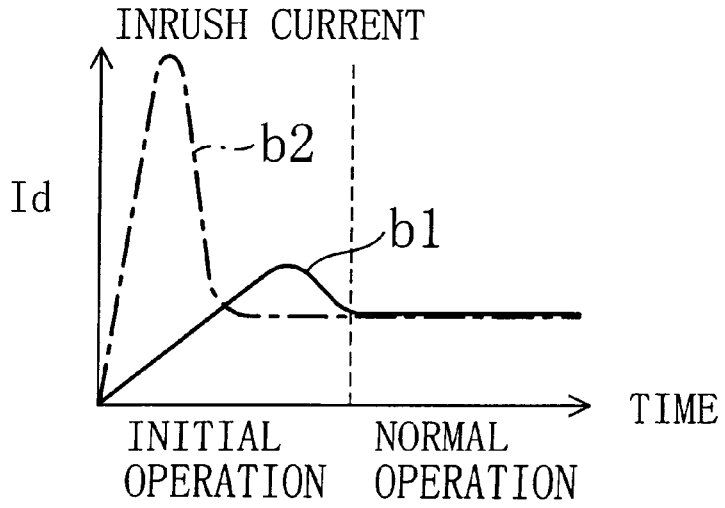

FIGS. 2(*a*) and 2(*b*) illustrate the operational concept of the power circuit shown in FIG. 1. Specifically, FIG. 2(*a*) is a graph illustrating respective variations in the gate-source voltage Vgs of the output transistor 1 with time. In FIG. 2(*a*), the solid line a1 represents the Vgs variation of a power circuit with the inrush current limiter 10, while the one dot chain a2 represents the Vgs variation of a power circuit without the inrush current limiter 10. FIG. 2(*b*) is a graph illustrating respective variations in current Id supplied by the output transistor 1 with time. In FIG. 2(*b*), the solid line b1 represents the Id variation of a power circuit with the inrush current limiter 10, while the one dot chain b2 represents the Id variation of a power circuit without the inrush current limiter 10.

As represented by the one dot chains a2 and b2 in FIGS. 2(*a*) and 2(*b*), if the inrush current limiter 10 is not provided, the gate-source voltage Vgs is high during the initial operation, and therefore, an excessively large current, i.e., so-called inrush current, flows unintentionally. In contrast, if the inrush current limiter 10 is provided, the gate-source voltage Vgs gradually increases from a very small value during the initial operation. After the circuit has started to operate normally, the output transistor 1 is controlled similarly to that of a circuit not including the inrush current limiter 10. By performing control in such a manner, the generation of inrush current can be suppressed during the initial operation as represented by the solid lines a1 and b1. It is noted that the initial operation mode is changed into the normal operation mode at a point in time a predetermined interval has passed since the start of operation or when the voltage Vgs controlled by the inrush current limiter 10 exceeds the voltage Vgs for the normal operation.

Figure 3:
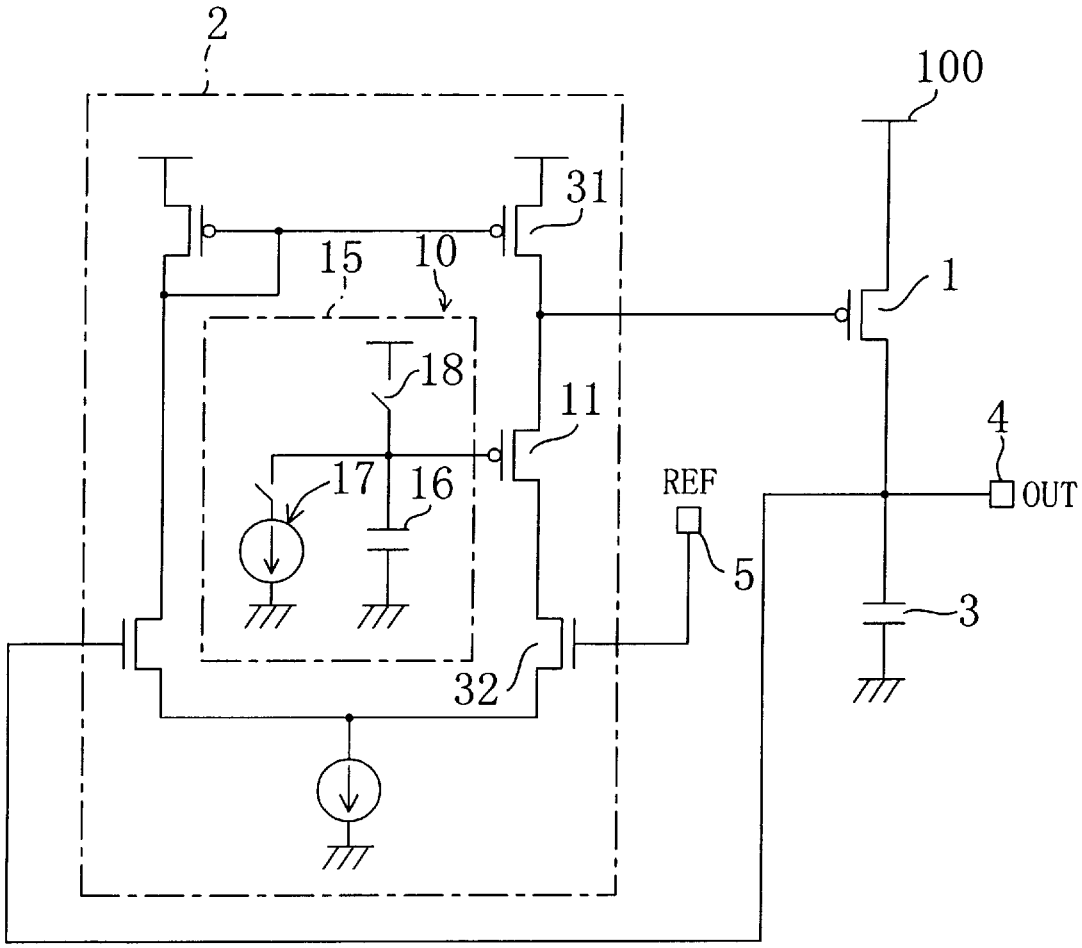
FIG. 3 is a diagram illustrating an exemplary realization of the power circuit shown in FIG. 1.

FIG. 3 illustrates an exemplary detailed realization of the power circuit shown in FIG. 1. As shown in FIG. 3, a limiting transistor 11 is provided between a pair of transistors 31 and 32, which together constitute a current path at the output stage of the differential amplifier 2. Also, an operation controller 15 is provided for controlling the gate potential of the limiting transistor 11. The inrush current limiter 10 is made up of the limiting transistor 11 and the operation controller 15.

In a circuit not including the limiting transistor 11, the reference voltage REF is higher than the output voltage OUT during the initial operation. Accordingly, the transistor 31 supplies no charges to the gate of the output transistor 1 and the transistor 32 extract charges from the gate of the output transistor 1. As a result, the gate potential of the output transistor 1 drops to generate the inrush current.

To limit the inrush current, the limiting transistor 11 is provided according to this embodiment, thereby suppressing the operation of the transistor 32 extracting charges from the gate of the output transistor 1. Since the limiting transistor 11 actually operates as a source follower circuit, the gate potential of the output transistor 1 is equal to the sum of the gate potential of the limiting transistor 11 and the threshold voltage of the transistor 1. Accordingly, if the gate potential of the limiting transistor 11 is controlled, then the gate-source voltage Vgs of the output transistor 1 can be controlled.

Thus, the operation controller 15 sets the gate potential of the limiting transistor 11 relatively high during the initial operation of the power circuit, and then gradually lowers the potential with the passage of time. Accordingly, the gate-source voltage Vgs of the output transistor 1 gradually increases from a very small value, and therefore, the generation of the inrush current can be suppressed. On and after a predetermined time has passed, the gate potential of the limiting transistor 11 is sufficiently low. In addition, since the output voltage OUT is equalized with the reference voltage REF, the transistor 31 starts to supply charges to the gate of the output transistor 1. In such a situation, the limiting transistor 11 has no longer any effect on the operation of the differential amplifier 2 and the power circuit automatically starts to operate normally.

The operation controller 15 includes a capacitor 16, a switching current source 17 and a charging switch 18. One terminal of the capacitor 16 is connected to the gate of the limiting transistor 11, while the other terminal thereof is grounded. The potential at the former terminal is used to control the gate potential of the limiting transistor 11. The switching current source 17 has its positive terminal connected to the non-grounded terminal of the capacitor 16 and its negative terminal grounded. While the switch is ON, the current source is operating to gradually extract charges stored in the capacitor 16. The charging switch 18, which is exemplary capacitor initializing means as defined in the appended claims, is provided between the non-grounded terminal of the capacitor 16 and the power supply. In its ON state, the switch 18 charges the capacitor 16 to the supply voltage.

Before the power circuit starts to operate, the operation controller 15 turns the charging switch 18 ON without turning the switching current source 17 ON, thereby pre-charging the capacitor 16. As a result, the capacitor 16 is charged to the supply voltage and the gate potential of the limiting transistor 11 is set at the supply voltage. When the power circuit starts to operate, the operation controller 15 turns the charging switch 18 OFF and the switching current source 17 ON. As a result, the capacitor 16 is gradually discharged, i.e., its voltage gradually decreases, during the initial operation. Accordingly, the gate potential of the limiting transistor 11 also decreases gradually.

Figure 4:
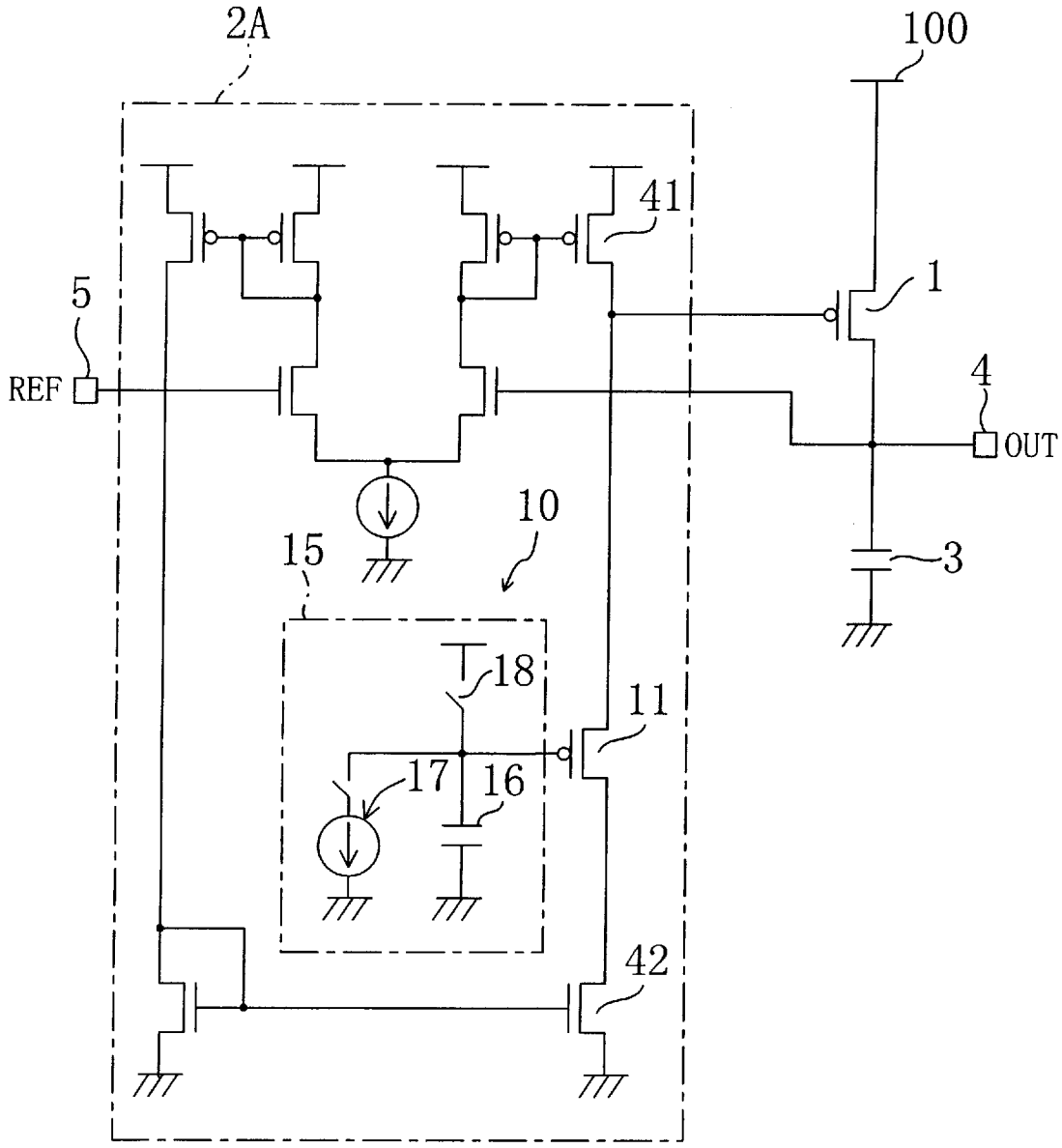
FIG. 4 is a diagram illustrating another exemplary realization of the power circuit shown in FIG. 1.

FIG. 4 illustrates another exemplary detailed realization of the power circuit shown in FIG. 1. In FIG. 4, the differential amplifier 2A is implemented as an operational transconductance amplifier (OTA). As shown in FIG. 4, the limiting transistor 11 is provided between a pair of transistors 41 and 42, which together constitute a current path at the output stage of the differential amplifier 2A of the OTA type. The operation controller 15 has the same configuration as the counterpart illustrated in FIG. 3. The inrush current limiter 10 shown in FIG. 4 also operates in the same way as the counterpart shown in FIG. 3, and the description thereof will be omitted herein.

In the power circuit according to the present invention, no transistors but the output transistor 1 need to be provided between the power supply terminal 100 and the output terminal 4 unlike a conventional circuit. That is to say, since no large-sized transistor should be connected in series to the output transistor 1, the generation of inrush current can be suppressed substantially without increasing the layout area of the power circuit. Also, even when a large current should be supplied as the output current, an output voltage approximating the supply voltage can be supplied.

In the foregoing description, a power circuit including a single-stage differential amplifier or a differential amplifier of the OTA type has been exemplified. It should be noted, however, the present invention is in no way limited to these specific embodiments. Thus, any other differential amplifier, such as a two-stage differential amplifier, may also be used instead. In such a case, the inrush current limiter can also be formed easily by providing the limiting transistor on the current path at the output stage of the differential amplifier. Although an n-channel differential amplifier is used in the foregoing embodiment, a p-channel differential amplifier may be naturally used.

Hereinafter, various alternative examples of the inrush current limiter according to the first embodiment will be exemplified.

ALTERNATIVE EXAMPLE 1

Figure 5:
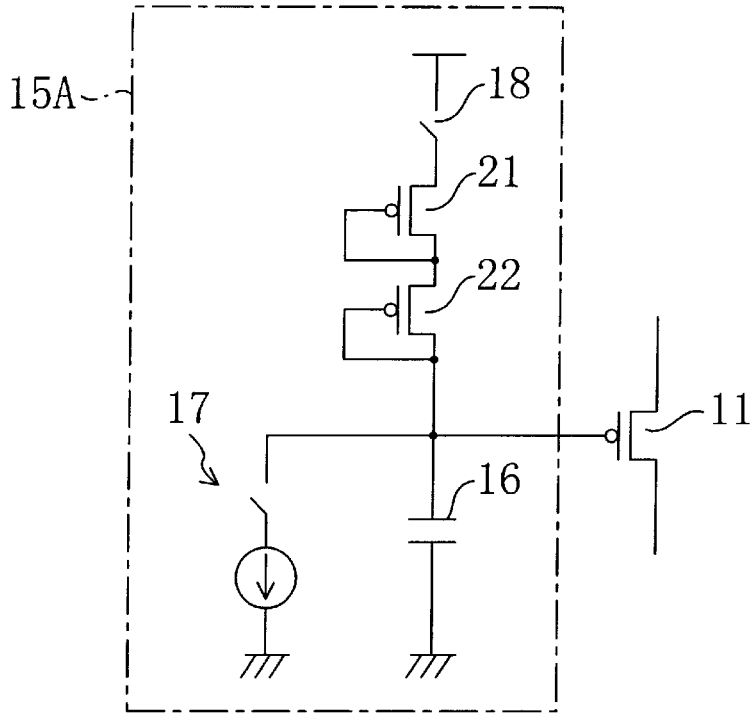
FIG. 5 is a diagram illustrating a first alternative configuration of the inrush current limiter.

FIG. 5 illustrates a first alternative configuration of the inrush current limiter according to the first embodiment. In the operation controller 15A shown in FIG. 5, the charging switch 18 and diode-connected transistors 21 and 22 are connected in series between one terminal of the capacitor 16 and the power supply. Exemplary capacitor initializing means as defined in the appended claims is made up of the switch 18 and transistors 21 and 22. By additionally providing these diode-connected transistors 21 and 22, the capacitor 16 can be charged to a voltage represented as (supply voltage−threshold voltage of transistor×2) before the power circuit starts to operate.

The output transistor 1 starts to supply current when the gate potential thereof reaches (supply voltage−threshold voltage of transistor), i.e., when the gate potential of the limiting transistor 11 reaches (supply voltage−threshold voltage of transistor×2). Thus, a power circuit with the inrush current limiter shown in FIG. 5 can start to operate normally earlier than that shown in FIG. 3 or 4 by the time taken for the gate potential of the output transistor 1 to reach (supply voltage-threshold voltage of transistor).

Even if only a single diode-connected transistor is provided, the same effects can be attained. That is to say, the power circuit can start to operate normally than the counterpart shown in FIG. 3 or 4.

ALTERNATIVE EXAMPLE 2

Figure 6:
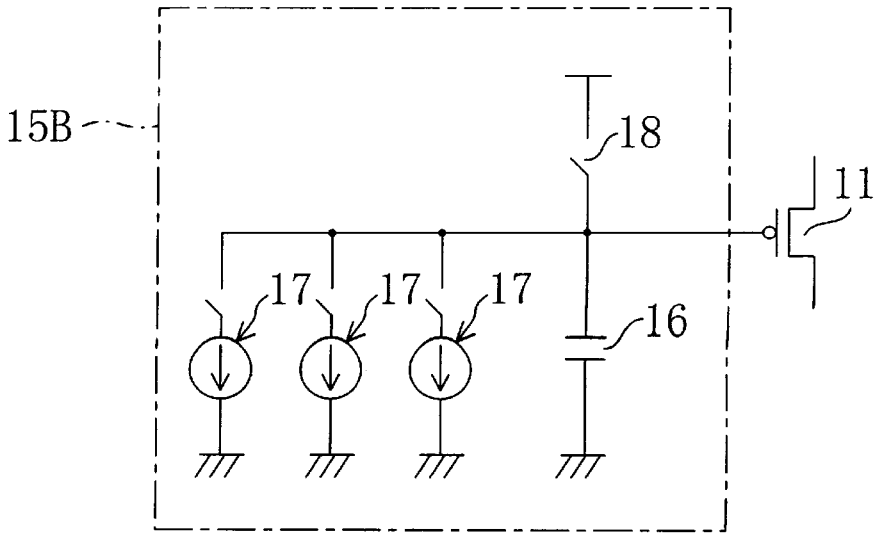
FIG. 6 is a diagram illustrating a second alternative configuration of the inrush current limiter.

FIG. 6 illustrates a second alternative configuration of the inrush current limiter according to the first embodiment. The operation controller 15B shown in FIG. 6 includes a plurality of switching current sources 17, which are selectively turned ON. When only one switching current source 17 is provided as in FIG. 3 or 4, the discharging rate of the capacitor 16 is defined by the ability of the single current source 17. Thus, the rise time of the power circuit is also fixed. In contrast, according to the configuration shown in FIG. 6, the discharging rate of the capacitor 16 can be variable by selectively turning ON an arbitrary number of current sources 17. For example, if there is no concern about the generation of inrush current, then the rise time of the power circuit can be shortened by increasing the discharging rate of the capacitor 16.

Also, when no charges are stored in the smoothing capacitor 3, the inrush current is more likely to generate, for instance. Thus, in such a situation, the inrush current can be limited by turning ON a current source with relatively low ability (or just one of the current sources of equal ability). On the other hand, if a certain quantity of charges have already been stored in the smoothing capacitor 3, then the inrush current is less likely to generate. Accordingly, the power circuit can be activated more rapidly by turning ON a current source with relatively high ability (or several current sources of an equal ability at the same time).

In this case, the discharging rate of the capacitor 16 may be changed either by selectively turning ON appropriate one of the current sources 17 of mutually different abilities or a required number of current sources 17 of equal ability.

ALTERNATIVE EXAMPLE 3

Figure 7:
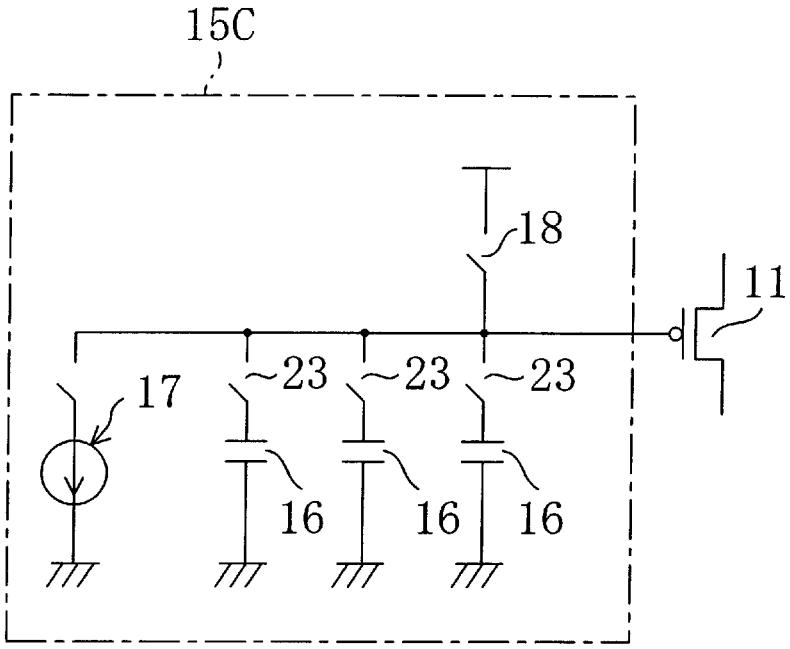
FIG. 7 is a diagram illustrating a third alternative configuration of the inrush current limiter.

FIG. 7 illustrates a third alternative configuration of the inrush current limiter acccording to the first embodiment. The operation controller 15B shown in FIG. 6 includes a plurality of switching current sources 17, while the operation controller 15C includes a plurality of capacitors 16 instead. Also, switches 23 are further provided between the gate of the limiting transistor 11 and the respective capacitors 16 such that the capacitors 16 are selectively charged or discharged. According to the configuration shown in FIG. 7, the total capacitance of the capacitors 16 can be changed by selectively charging or discharging an arbitrary number of capacitors 16 using the switches 23.

If the total capacitance of the capacitors 16 is relatively large, then it takes a longer time for the current source 17 to discharge the capacitors 16, thus limiting the inrush current. Conversely, if the total capacitance of the capacitors 16 is relatively small, then the capacitors 16 are discharged more quickly. As a result, the power circuit can also be activated in a shorter time. In other words, the gate potential of the limiting transistor 11 decreases at a rate variable with the total capacitance of the capacitors 16. Accordingly, the inrush current limiter 15C can perform the same function as the inrush current limiter 15B shown in FIG. 6.

In this case, the total capacitance of the capacitors 16 may be changed either by selectively charging or discharging appropriate one of the capacitors 16 with mutually different capacitances or a required number of capacitors 16 of equal capacitance.

ALTERNATIVE EXAMPLE 4

Figure 8:
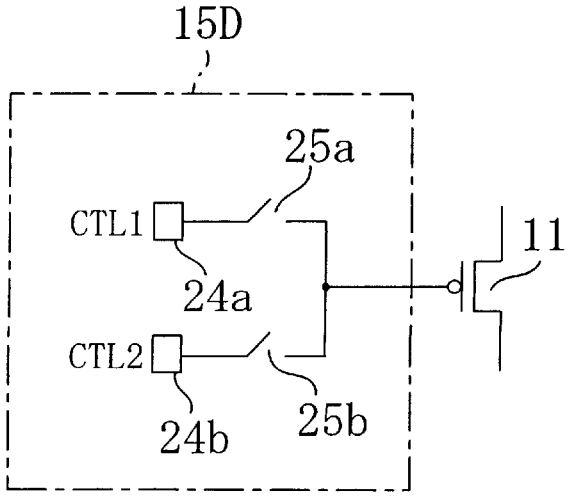
FIG. 8 is a diagram illustrating a fourth alternative configuration of the inrush current limiter.

FIG. 8 illustrates a fourth alternative configuration of the inrush current limiter according to the first embodiment. The operation controller 15D shown in FIG. 8 includes a pair of terminals 24*a* and 24*b*, to which first and second control potentials CTL1 and CTL2 are respectively applied. The controller 15D further includes a pair of switches 25*a* and 25*b* for selectively applying the first and second control potentials CTL1 and CTL2, respectively, to the gate of the limiting transistor 11.

The first control potential CTL1 is preset at such a value as suppressing the generation of inrush current through the operation of the limiting transistor 11 when the potential CTL1 is applied to the gate of the limiting transistor 11. On the other hand, the second control potential CTL2 is preset at such a value that even when the potential CTL2 is applied to the gate of the limiting transistor 11, the normal operation of the differential amplifier is not affected by the limiting transistor 11.

During the initial operation of the power circuit, the switch 25*a* is turned ON and the first control potential CTL1 is applied to the gate of the limiting transistor 11. When the power circuit starts to operate normally after a predetermined time has passed, the switch 25*b* is turned ON and the second control potential CTL2 is applied to the gate of the limiting transistor 11. By performing these operations, the generation of inrush current can be suppressed.

A plurality of first control potentials CTL1 may be prepared and selectively applied depending on the operation intended.

ALTERNATIVE EXAMPLE 5

Figure 9:
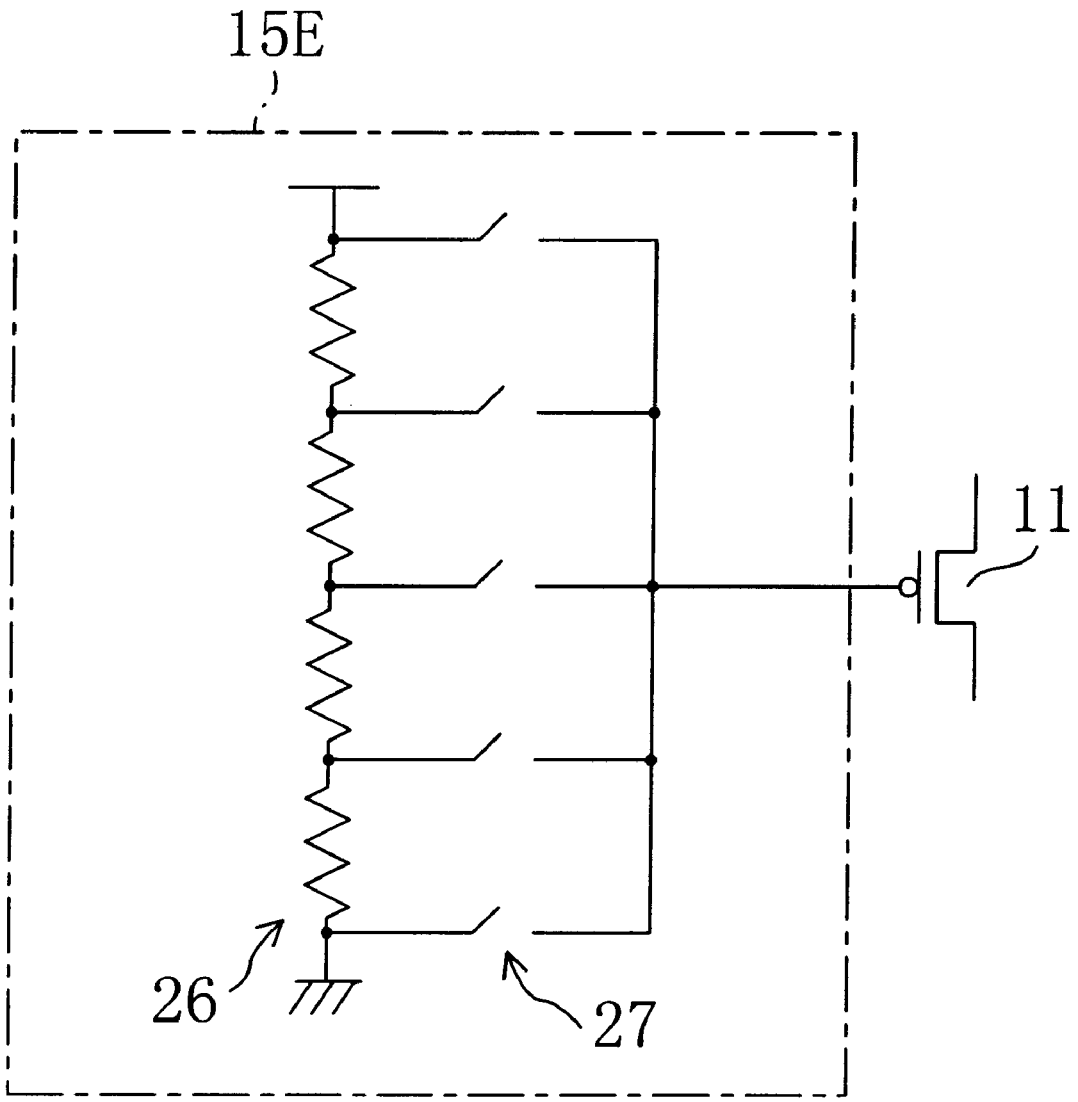
FIG. 9 is a diagram illustrating a fifth alternative configuration of the inrush current limiter.

FIG. 9 illustrates a fifth alternative configuration of the inrush current limiter according to the first embodiment. The operation controller 15E shown in FIG. 9 sets respective potentials, corresponding to the first and second control potentials CTL1 and CTL2 shown in FIG. 8, by dividing the supply voltage using resistors. Specifically, a bank 26 of resistors connected in series is provided between the power supply and the ground, thereby dividing the potential difference therebetween into a plurality of potentials, one of which is selected by a potential selector 27 made up of a plurality of switches. And the potential selected is applied to the gate of the limiting transistor 11.

During the initial operation of the power circuit, the potential selector 27 sequentially applies the potentials to the gate of the limiting transistor 11 in the ascending order, i.e., beginning with the highest one. As a result, the generation of inrush current can be suppressed. On the other hand, during the normal operation, the potential selector 27 applies the ground potential to the gate of the limiting transistor 11, thereby turning the limiting transistor 11 ON. Accordingly, the differential amplifier operates normally.

ALTERNATIVE EXAMPLE 6

Figure 10:
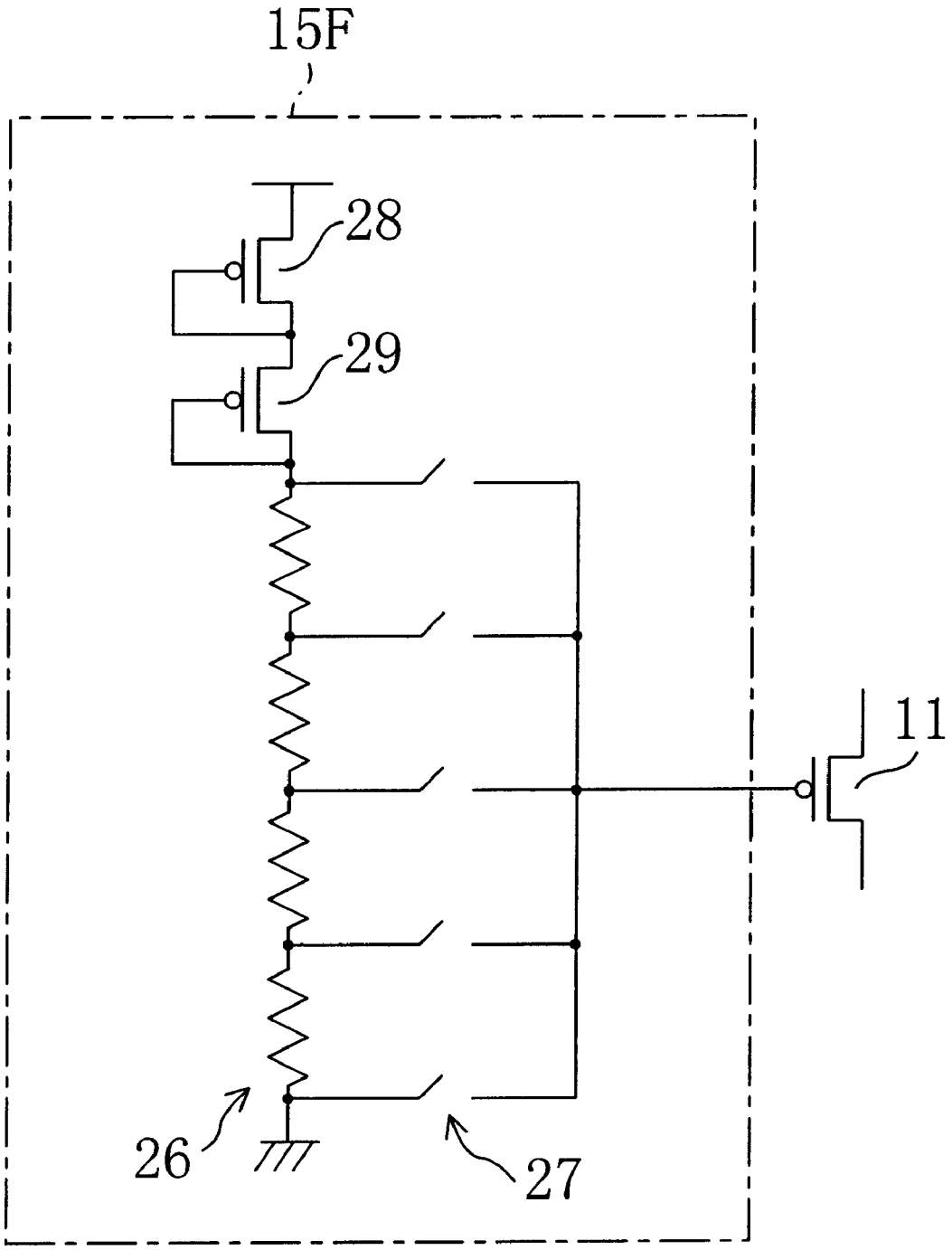
FIG. 10 is a diagram illustrating a sixth alternative configuration of the inrush current limiter.

FIG. 10 illustrates a sixth alternative configuration of the inrush current limiter according to the first embodiment. The operation controller 15F further includes a pair of diode-connected transistors 28 and 29 between the power supply and the resistor bank 26 of the operation controller 15E shown in FIG. 9.

As described in the first alternative example, the output transistor 1 starts to supply current when the gate potential of the limiting transistor 11 reaches (supply voltage−threshold voltage of transistor×2). Thus, in the operation controller 15F shown in FIG. 10, the potential at the upper end of the resistor bank 26 is set at (supply voltage−threshold voltage of transistor×2) by providing the pair of diode-connected transistors 28 and 29. In such a configuration, the resistance of the resistor bank 26 can be reduced compared to the example illustrated in FIG. 9.

The same effects are attainable with only one diode-connected transistor provided.

(Modified example of power circuit shown in FIG. 3)

Figure 11:
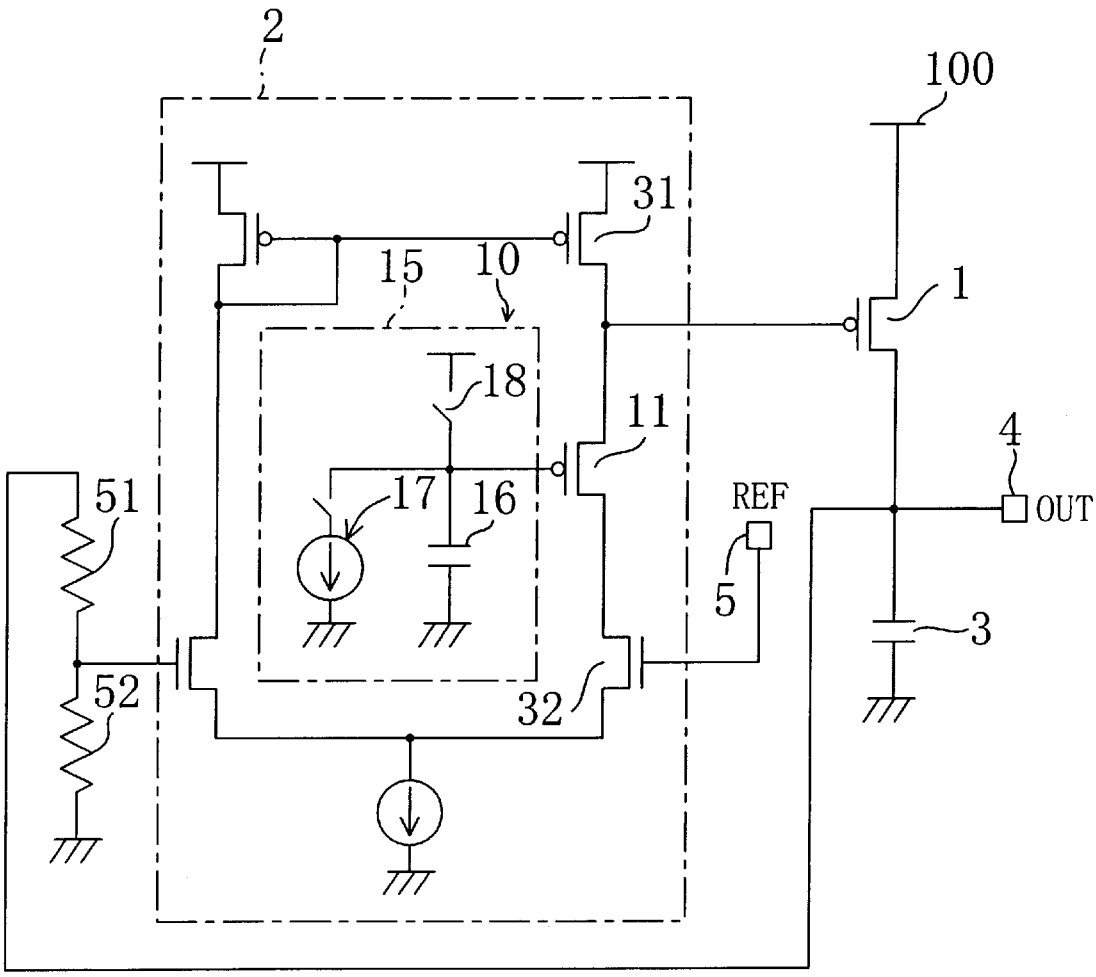
FIG. 11 is a diagram illustrating a modified example of the power circuit shown in FIG. 3, in which the output voltage is divided using resistors and then the voltage divided is fed back to the differential amplifier.

FIG. 11 illustrates a modified example of the power circuit shown in FIG. 3. In FIG. 11, the output voltage OUT is divided using resistors 51 and 52 and then the divided voltage is fed back to the differential amplifier 2. In this manner, the output voltage OUT can be set higher than the reference voltage REF.

Figure 12:
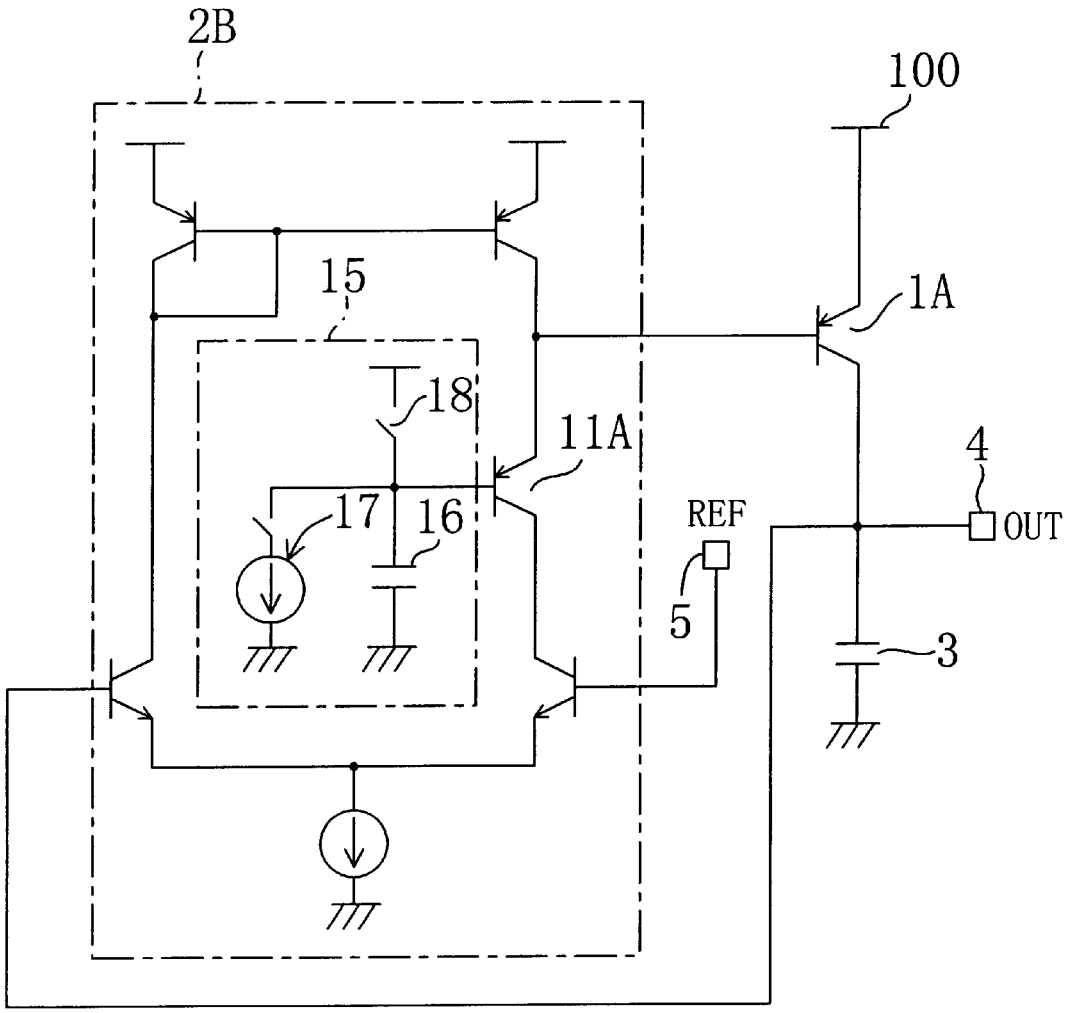
FIG. 12 is a diagram illustrating another modified example of the power circuit shown in FIG. 3, in which the output transistor and respective transistors of the differential amplifier are implemented as bipolar transistors.

The power circuit shown in FIG. 3 includes MOS transistors. The present invention, however, is in no way limited to such an embodiment. For example, the present invention is easily applicable to an alternative power circuit shown in FIG. 12, in which an output transistor 1A and respective transistors of a differential amplifier 2B are implemented as bipolar transistors.

Figure 13:
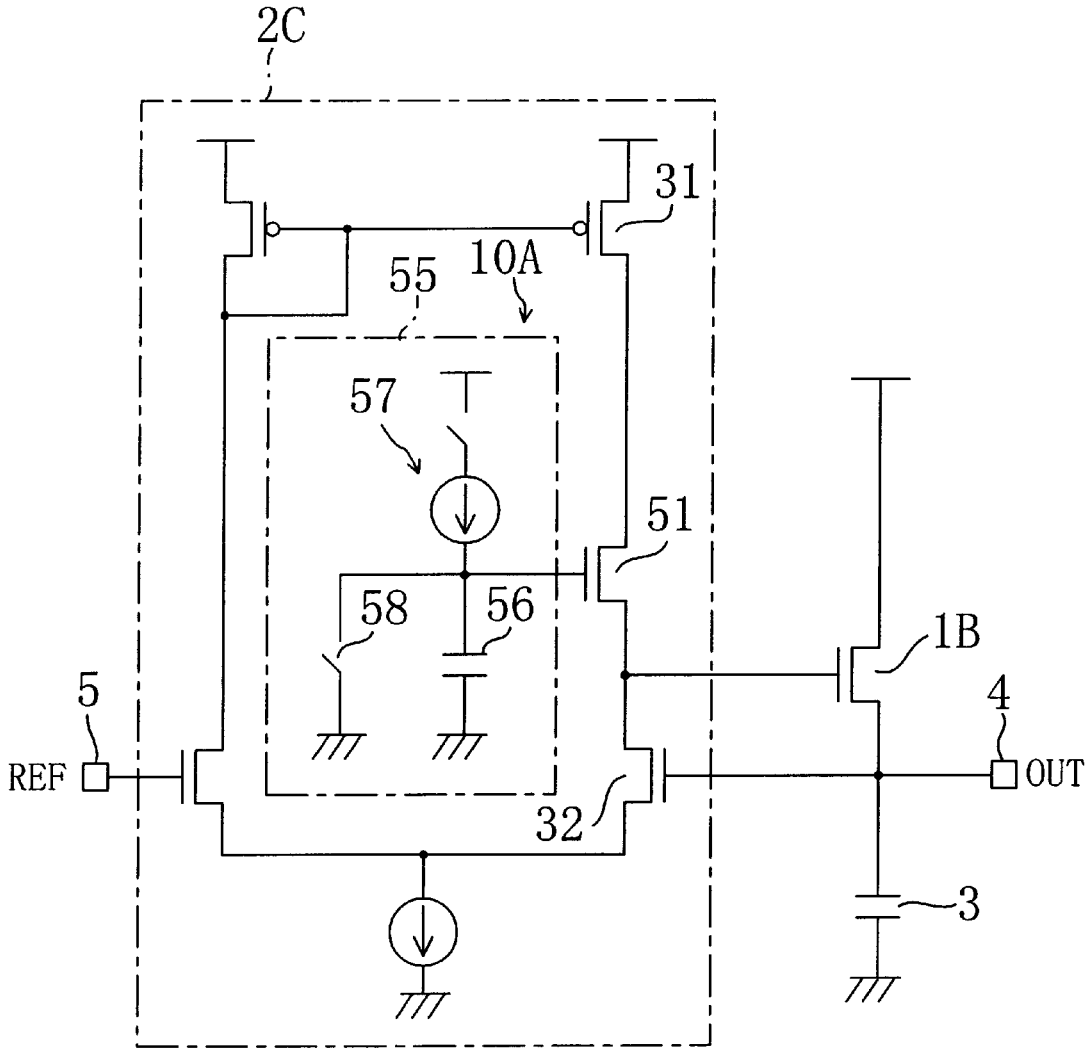
FIG. 13 is a diagram illustrating another modified example of the power circuit shown in FIG. 3, in which the output transistor is implemented as an n-channel transistor.

Also, in the power circuit shown in FIG. 3, a p-channel transistor is used as the output transistor 1. Alternatively, an n-channel transistor may also be used as the output transistor 1B as shown in FIG. 13. In such a case, an inrush current limiter 10A gradually increases the gate potential of the output transistor 1B from the ground potential during the initial operation of the power circuit.

Unlike the inrush current limiter 10 shown in FIG. 3, the inrush current limiter 10A shown in FIG. 13 includes an n-channel limiting transistor 51 and an operation controller 55. The n-channel limiting transistor 51 is provided between a pair of transistors 31 and 32, which together constitute a current path at the output stage of a differential amplifier 2C. The operation controller 55 controls the gate potential of the limiting transistor 51.

The operation controller 55 includes a capacitor 56, a switching current source 57 and a discharging switch 58. one terminal of the capacitor 56 is connected to the gate of the limiting transistor 51, while the other terminal thereof is grounded. The potential at the former terminal is used to control the gate potential of the limiting transistor 51. The switching current source 57 has its positive terminal connected to the power supply terminal and its negative terminal connected to the non-grounded terminal of the capacitor 56. While the switch is ON, the current source 57 is operating to gradually supply charges to the capacitor 56. The discharging switch 58, which is exemplary capacitor initializing means as defined in the appended claims, is provided between the non-grounded terminal of the capacitor 56 and the ground terminal. In its ON state, the switch 58 discharges the capacitor 56.

Before the power circuit starts to operate, the operation controller 55 turns the discharging switch 58 ON without turning the switching current source 57 ON, thereby pre-discharging the capacitor 56. As a result, the capacitor 56 is discharged to zero volts and the gate potential of the limiting transistor 51 is set at the ground potential. When the power circuit starts to operate, the operation controller 55 turns the discharging switch 58 OFF and the switching current source 57 ON. As a result, the capacitor 56 is gradually charged, i.e., its voltage gradually increases, during the initial operation. Accordingly, the gate potential of the limiting transistor 51 also increases gradually. Since the limiting transistor 51 operates as a source follower circuit, the gate potential of the output transistor 1B gradually increases and the generation of inrush current can be suppressed.

Embodiment 2

Figure 14:
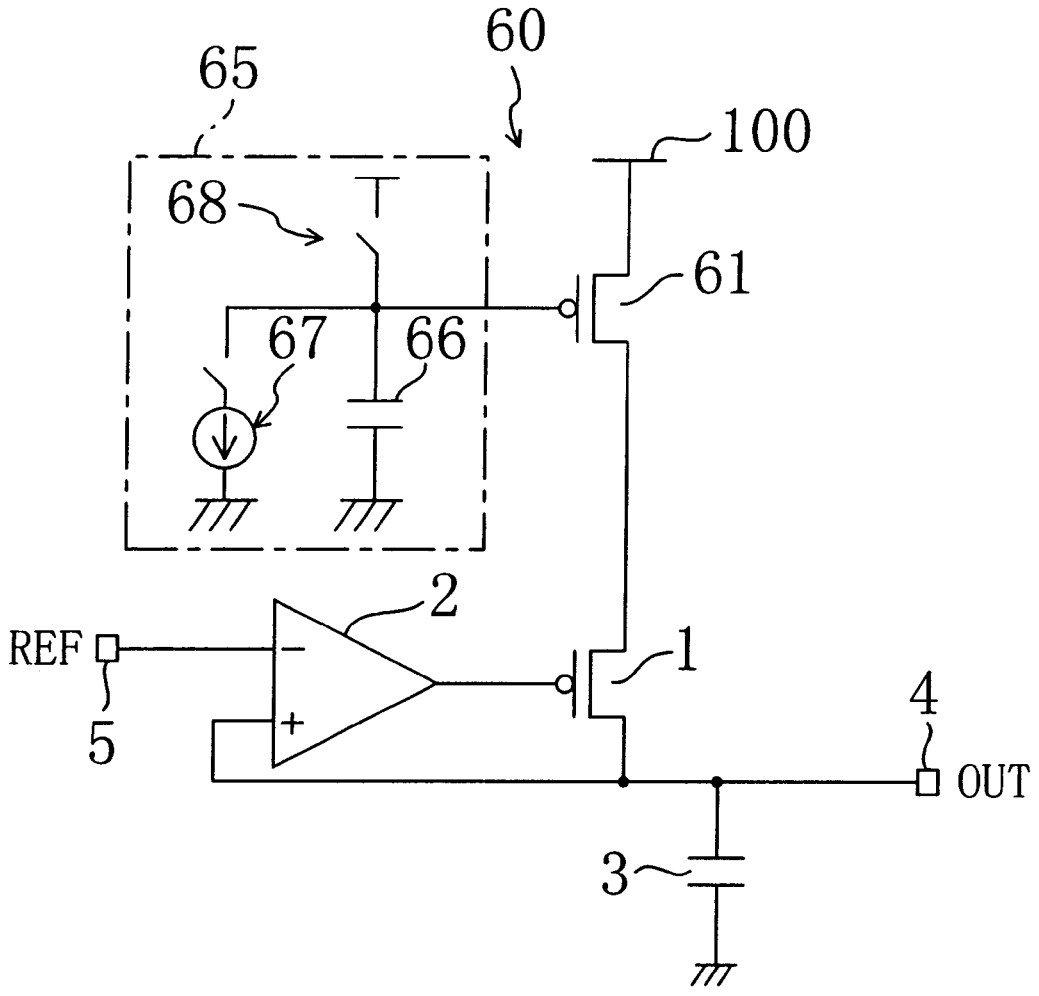
FIG. 14 is a diagram illustrating an exemplary circuit configuration of a power circuit according to a second embodiment of the present invention.

FIG. 14 illustrates an exemplary circuit configuration of a power circuit with an inrush current limiter according to a second embodiment of the present invention. In FIG. 14, a limiting transistor 61 is connected in series to the output transistor 1, and an operation controller 65 similar to that of the first embodiment is connected to the gate of the limiting transistor 61. That is to say, the operation controller 65 also includes a capacitor 66, a switching current source 67 and a charging switch 68. An inrush current limiter 60 is made up of the limiting transistor 61 and the operation controller 65.

During the initial operation of the power circuit, the operation controller 65 applies a potential at one terminal of the capacitor 66, which gradually decreases from the supply voltage, to the gate of the limiting transistor 61, thereby suppressing the generation of the inrush current. On the other hand, the gate potential of the limiting transistor 61 is equal to the ground potential during the normal operation of the power circuit. Accordingly, the limiting transistor 61 is ON and hardly affects the operation of the power circuit. In this embodiment, however, a current corresponding to the output current flows through the limiting transistor 61 during the normal operation of the power circuit, and therefore, the limiting transistor 61 should be of a relatively large size. Thus, compared to the power circuit of the first embodiment, the layout area should be rather increased.

Figure 15:
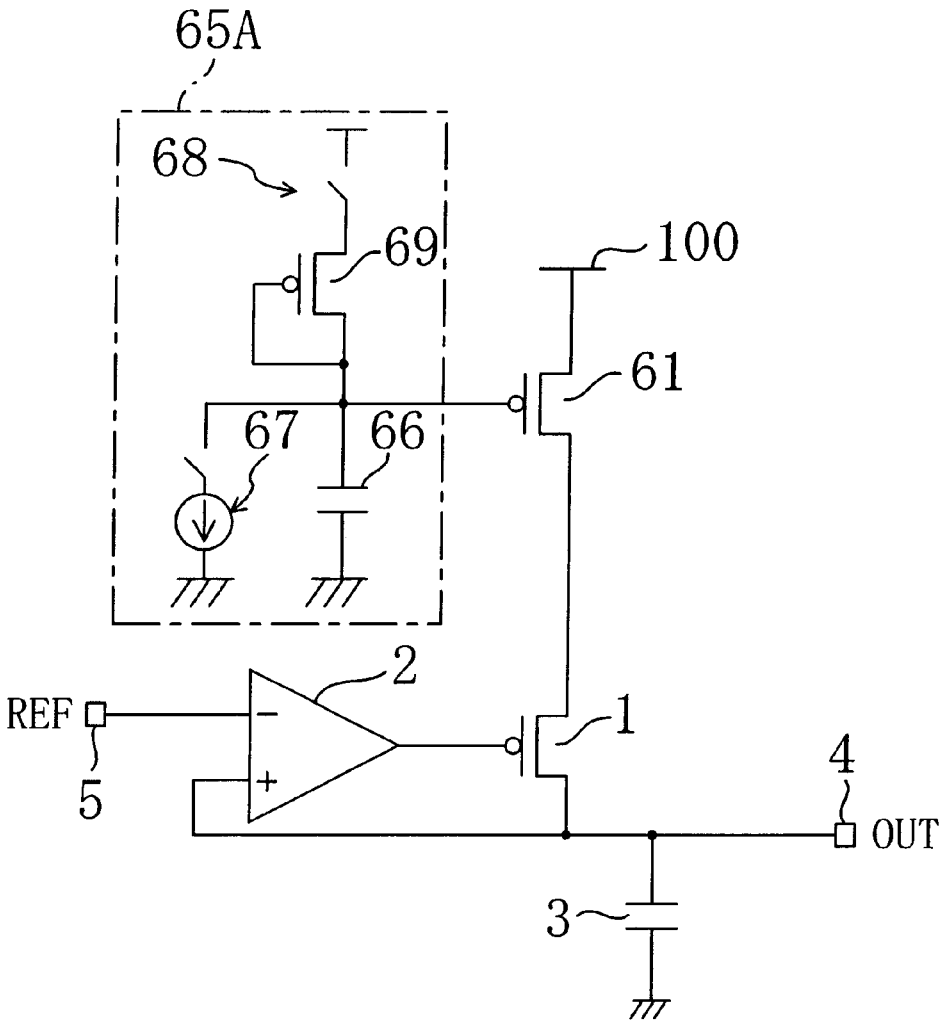
FIG. 15 is a diagram illustrating another exemplary circuit configuration of the power circuit according to the second embodiment.

FIG. 15 illustrates a modified example of the power circuit shown in FIG. 14. Like the operation controller 15A shown in FIG. 5 according to the first embodiment, the operation controller 65A includes a charging switch 68 and a diode-connected transistor 69, which are connected in series between the power supply terminal and the capacitor 66. The limiting transistor 61 starts to supply current when the gate potential thereof reaches (supply voltage–threshold voltage of transistor). Accordingly, the rise time of the power circuit can be shortened by setting the charged potential of the capacitor 66 at (supply voltage–threshold voltage of transistor) using the diode-connected transistor 69.

Any other alternative example of the inrush current limiter as described in the first embodiment is also applicable to the power circuit according to the second embodiment.

It is noted that a controller for inhibiting the inrush current limiter may be additionally provided for the power circuit according to the first or second embodiment.

The inrush current generates when substantially no charges are stored in the smoothing capacitor 3 and the output voltage is much lower than the preset reference voltage before the power circuit starts to operate. However, if the smoothing capacitor 3 has been charged to a potential approximating the reference voltage before the power circuit starts to operate, then no inrush current generates.

Accordingly, if the smoothing capacitor 3 has already been charged before the power circuit starts to operate, the inrush current limiter according to the present invention need not be operated. Should the inrush current limiter be activated in such a situation, the rise time of the power circuit gets longer to the contrary. Thus, in a power circuit including such a controller for inhibiting the inrush current limiter, the generation of inrush current can be suppressed when required. And if there is no need to limit the inrush current, the inrush current limiter may be inhibited and the power circuit can be activated rapidly enough.

For example, such a controller for inhibiting the inrush current limiter should be provided for a system intended to intermittently operate a power circuit such that the power dissipation can be reduced when the output current is small. In such a case, the power circuit is alternately and repeatedly turned ON/OFF with the smoothing capacitor always charged. Accordingly, the inrush current limiter should be enabled only when the power circuit is turned ON for the first time. That is to say, such a power circuit should preferably be activated in a short time and the inrush current limiter should be inhibited in the other situations. Accordingly, such a system preferably includes the controller for inhibiting the inrush current limiter.

Figure 16:
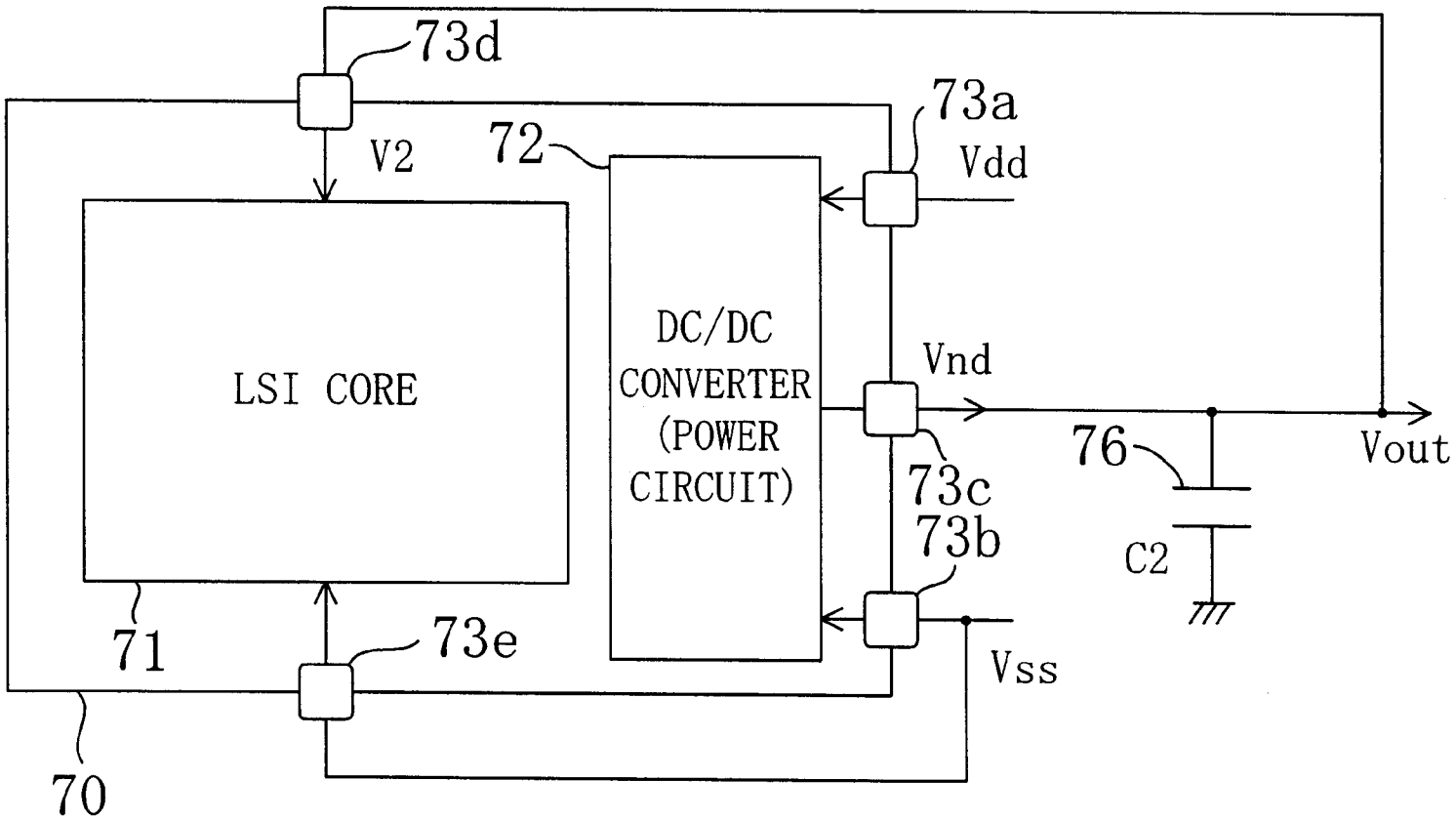
FIG. 16 is a diagram illustrating a schematic configuration of an integrated circuit including the power circuit of the present invention.
Figure 17:
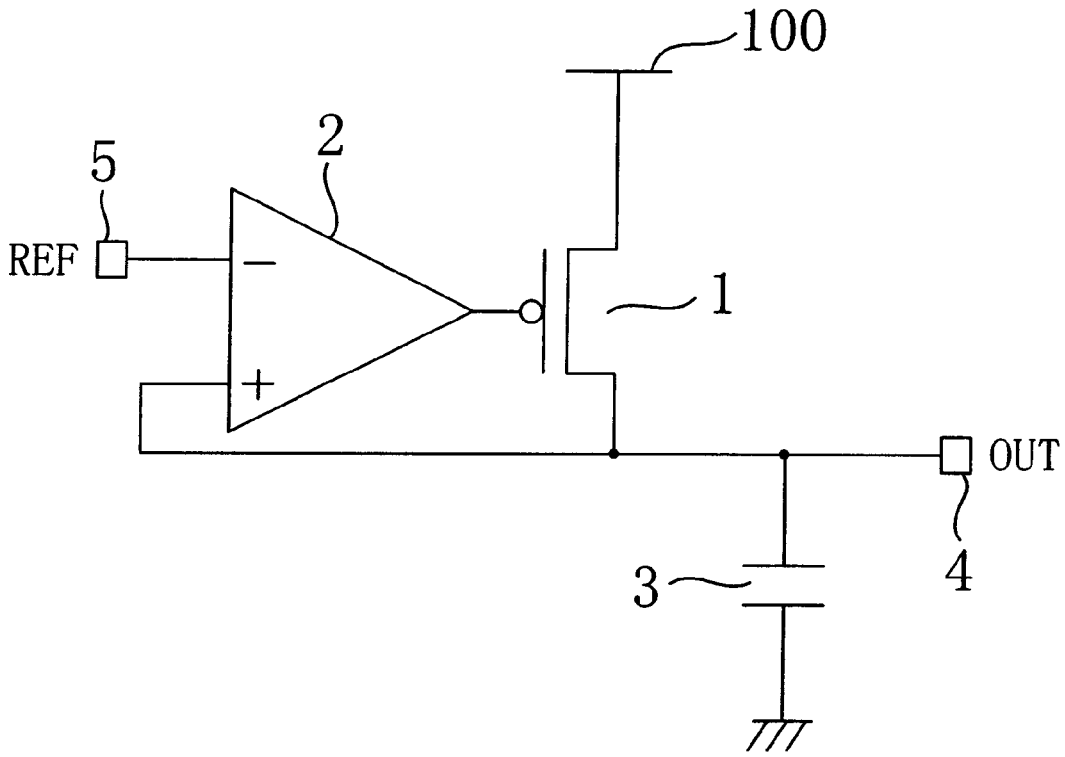
Fig. 17 PRIOR ART
FIG. 17 is a diagram illustrating a configuration of a conventional power circuit not including the inrush current limiter.

FIG. 16 illustrates an LSI system including the power circuit according to the present invention. As shown in FIG. 16, an integrated circuit 70 includes: an LSI core 71; a DC—DC converter 72 as the power circuit; and a capacitor 76 15 as an external component. The integrated circuit 70 further includes pads 73*a* through 73*e*. The DC—DC converter 72 includes the inrush current limiter of the present invention, converts supply voltages Vdd and vss, which have been applied to the pads 73*a* and 73*b*, into a voltage Vnd through the above-described operations and outputs the voltage Vnd to the pad 73*c*. The output voltage Vnd of the DC—DC converter 72 is output as a voltage Vout. The output voltage Vout is supplied as an internal supply voltage to the LSI core 71.

As is apparent from the foregoing description, the current supplied by the output transistor can be gradually increased by the inrush current limiter according to the present invention during the initial operation of the power circuit. Thus, the generation of inrush current can be suppressed during the initial operation of the power circuit by adopting a configuration different from the conventional one. Also, the limiting transistor included in the inrush current limiter may be an MOS transistor, for example. Accordingly, no bipolar process is needed and the inrush-current-limiting power circuit can be fabricated only by a CMOS process. Moreover, if the limiting transistor is provided on the current path at the output stage of the differential amplifier, the generation of inrush current can be suppressed substantially without increasing the layout area of the power circuit. Furthermore, even when a large current should be supplied as the output current, an output voltage approximating the supply voltage can be provided.

While the present invention has been described in a preferred embodiment, it will be apparent to those skilled in the art that the disclosed invention may be modified in numerous ways and may assume many embodiments other than that specifically set out and described above. Accordingly, it is intended by the appended claims to cover all modifications of the invention which fall within the true spirit and scope of the invention.

What is claimed is:

1. A power circuit for converting a supply voltage and outputting the voltage converted, comprising:

an output transistor for supplying a current from a power supply to an output terminal;

a differential amplifier for controlling the current supplied by the output transistor in such a manner as to regulate a voltage at the output terminal based on a preset reference voltage; and means for limiting an inrush current by gradually increasing the current supplied by the output transistor during an initial operation of the power circuit, wherein the inrush-current-limiting means comprises:

a limiting transistor with such a source potential as controlling a gate potential of the output transistor, the limiting transistor being provided on a current path at an output stage of the differential amplifier; and an operation controller for controlling a gate potential of the limiting transistor.

2. The circuit of claim 1, wherein during the initial operation of the power circuit, the operation controller controls the gate potential of the limiting transistor at such a value as preventing the output transistor from supplying an excessively large current, and wherein during a normal operation of the power circuit, the operation controller controls the gate potential of the limiting transistor at such a value as turning the limiting transistor ON.

3. The circuit of claim 1, wherein the operation controller comprises:

a capacitor, a potential at one terminal of the capacitor being used to control the gate potential of the limiting transistor;

capacitor initializing means for setting a voltage of the capacitor at a predetermined voltage before the power circuit starts to operate; and a current source, which is selectively turned ON to gradually charge or discharge the capacitor.

4. The circuit of claim 3, wherein the capacitor initializing means comprises: a switch, which is selectively turned ON; and a transistor, which is connected to form a diode, the switch and the diode-connected transistor both being connected in series between the terminal of the capacitor and a power supply terminal or a ground terminal.

5. The circuit of claim 3, wherein the operation controller comprises a plurality of the current sources, which are selectively turned ON.

6. The circuit of claim 3, wherein the operation controller comprises a plurality of the capacitors, which are selectively charged or discharged.

7. The circuit of claim 1, wherein the operation controller is supplied with first and second control potentials, which are selected by the operation controller during the initial operation and the normal operation of the power circuit, respectively, and wherein the operation controller controls the gate potential of the limiting transistor in accordance with the control voltage selected.

8. The circuit of claim 1, wherein the operation controller comprises:

a bank of resistors that are connected in series to each other, the bank dividing a potential between both terminals thereof into a plurality of potentials; and means for selecting one of the potentials produced by the bank, and wherein the operation controller controls the gate potential of the limiting transistor in accordance with the potential selected by the selecting means.

9. A power circuit for converting a supply voltage and outputting the voltage converted, comprising:

an output transistor for supplying a current from a power supply to an output terminal;

a differential amplifier for controlling the current supplied by the output transistor in such a manner as to regulate a voltage at the output terminal based on a preset reference voltage; and means for limiting an inrush current by gradually increasing the current supplied by the output transistor during an initial operation of the power circuit, wherein the inrush-current-limiting means comprises:

a limiting transistor, which is provided between the power supply and the output terminal and connected in series to the output transistor; and an operation controller for controlling a gate potential of the limiting transistor.

10. The circuit of claim 9, wherein during the initial operation of the power circuit, the operation controller controls the gate potential of the limiting transistor at such a value as preventing the output transistor from supplying an excessively large current, and wherein during a normal operation of the power circuit, the operation controller controls the gate potential of the limiting transistor at such a value as turning the limiting transistor ON.

11. The circuit of claim 9, wherein the operation controller comprises:

a capacitor, a potential at one terminal of the capacitor being used to control the gate potential of the limiting transistor;

capacitor initializing means for setting a voltage of the capacitor at a predetermined voltage before the power circuit starts to operate; and a current source, which is selectively turned ON to gradually charge or discharge the capacitor.

12. An integrated circuit comprising the power circuit as recited in claim 1 and operating at a voltage that has been converted and output by the power circuit.

13. An integrated circuit comprising the power circuit as recited in claim 9 and operating at a voltage that has been converted and output by the power circuit.

* * * * *